US006178913B1

(12) United States Patent
Brignolio

(10) Patent No.: US 6,178,913 B1
(45) Date of Patent: Jan. 30, 2001

(54) COLLAPSIBLE BOAT

(76) Inventor: James C. Brignolio, 14755 S. Prescott Rd., Manteca, CA (US) 95336

( * ) Notice: Under 35 U.S.C. 154(b), the term of this patent shall be extended for 0 days.

(21) Appl. No.: 09/343,331

(22) Filed: Jun. 30, 1999

(51) Int. Cl.[7] ..... B63B 7/00
(52) U.S. Cl. ..... 114/353; 114/354; 114/61.18
(58) Field of Search ..... 114/344, 353, 114/354, 61.15, 61.18

(56) References Cited

U.S. PATENT DOCUMENTS

| | | | | |
|---|---|---|---|---|
| 119,348 | * | 9/1871 | Groel | 190/1 |
| 2,759,201 | * | 8/1956 | McKinney | 114/344 |
| 2,876,728 | | 3/1959 | Luger . | |
| 2,992,444 | | 7/1961 | Schuler . | |
| 3,108,295 | * | 10/1963 | Schor et al. | 114/354 |
| 3,193,851 | * | 7/1965 | Fiebelkorn | 114/344 |
| 3,210,783 | * | 10/1965 | Petty | 114/344 |
| 3,530,519 | * | 9/1970 | Levinson | 114/344 |
| 3,629,884 | * | 12/1971 | Brown | 114/344 |
| 3,673,622 | * | 7/1972 | Allen | 114/344 |
| 3,925,837 | | 12/1975 | Miller . | |
| 3,978,536 | | 9/1976 | Howe . | |
| 3,981,259 | * | 9/1976 | Harper, Jr. | 114/61 |
| 4,730,574 | * | 3/1988 | Deifendahl et al. | 114/354 |
| 4,754,723 | * | 7/1988 | Ghering | 114/353 |
| 4,909,169 | | 3/1990 | Skandaliaris et al. . | |

FOREIGN PATENT DOCUMENTS

| | | | | |
|---|---|---|---|---|
| 1062090 | * | 11/1979 | (CA) | 114/354 |
| 2817650 | * | 10/1978 | (DE) | 114/354 |
| 3312730 | * | 10/1984 | (DE) | 114/353 |
| 4305098 | * | 8/1994 | (DE) | 114/353 |
| 2223459 | * | 4/1990 | (GB) | 114/354 |
| 20981 | * | 8/1994 | (GB) | 114/353 |

* cited by examiner

*Primary Examiner*—S. Joseph Morano
*Assistant Examiner*—Ajay Vasudeva
(74) *Attorney, Agent, or Firm*—Thomas R. Lampe

(57) ABSTRACT

A collapsible boat includes two center deck panels and two outer deck panels, all of the deck panels being hingedly secured together. When the boat is in uncollapsed position all of the deck panels are disposed horizontally. When the boat is collapsed and the outer deck panels move toward one another, the two center deck panels raise to a vertical orientation.

18 Claims, 8 Drawing Sheets

COLLAPSIBLE BOAT

TECHNICAL FIELD

This invention relates to a collapsible boat and more particularly to boat structure enabling the width of the boat to be reduced for transport or storage purposes.

BACKGROUND OF THE INVENTION

The following United States patents disclose boat structures which can be collapsed to provide an alternate boat configuration: U.S. Pat. No. 3,925,837, issued Dec. 16, 1975, U.S. Pat. No. 2,876,728, issued Mar. 10, 1959, U.S. Pat. No. 4,909,169, issued Mar. 20, 1990, U.S. Pat. No. 3,978,536, issued Sep. 7, 1976, and U.S. Pat. No. 2,992,444, issued Jul. 18, 1961. These patents are believed to be representative of the current state of the prior art.

DISCLOSURE OF INVENTION

The invention disclosed and claimed herein also relates to a collapsible boat structure; however, the invention is characterized by its relative simplicity and ease of use. The structural components of the boat of this invention cooperate in a unique manner not suggested by the prior art to attain the desired result of quickly and reliably converting a boat between a non-collapsed condition in which the boat is suitable for normal boat usage on the water and a collapsed condition enabling the width of the boat to be reduced for the boat to be readily trailed after a vehicle or stored. The conversion takes place with virtually no manual effort on the part of the boat user.

The collapsible boat includes a boat deck comprising a plurality of boat deck panels including first and second center deck panels disposed side-by-side and first and second outer deck panels. The first outer deck panel is disposed alongside the first center deck panel and the first center deck panel is positioned between the second center deck panel and the first outer deck panel. The second outer deck panel is disposed alongside the second center deck panel and the second center deck panel is positioned between the first center deck panel and the second outer deck panel.

Panel mover means is provided for selectively moving the first and second outer deck panels either toward or away from one another. The first and second center deck panels move from a substantially horizontal orientation to a substantially vertical orientation when the first and second outer deck panels move toward one another to reduce the width of the boat deck.

The collapsible boat of this invention additionally includes guide means for guiding movement of the first and second outer deck panels. The panel mover means is operatively associated with the first and second outer deck panels to move the first and second outer deck panels along the guide means. The first and second center deck panels move responsive to movement of the first and second outer deck panels along the guide means.

Other features, advantages, and objects of the present invention will become apparent with reference to the following description and accompanying drawings.

MODES FOR CARRYING OUT THE INVENTION

Figure 1:
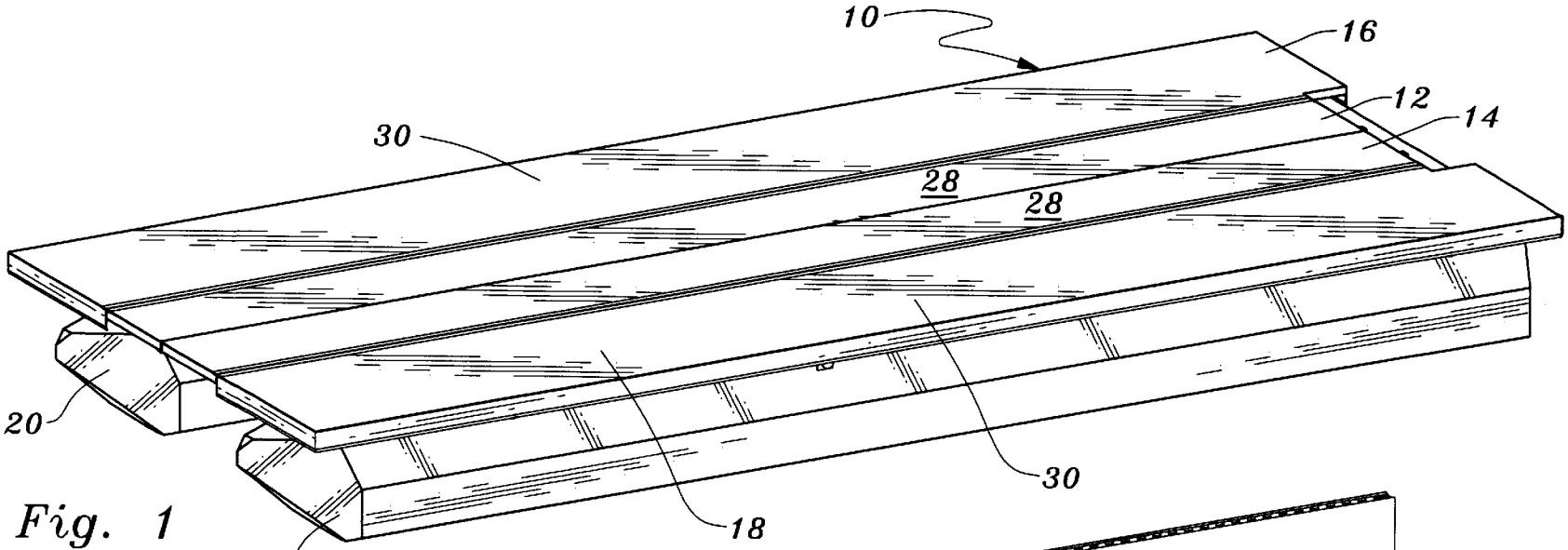
FIG. 1 is a perspective view of a boat constructed in accordance with the teachings of the present invention in non-collapsed condition.

Referring now to FIGS. 1–15, a collapsible boat constructed in accordance with the teachings of the present invention is illustrated. The boat includes a boat deck 10 including center deck panels 12, 14 disposed side-by-side and outer deck panels 16, 18. Outer deck panel 16 is disposed alongside center deck panel 12, the deck panel 12 being positioned between center deck panel 14 and outer deck panel 16. Outer deck panel 18 is disposed alongside the center deck panel 14 and the center deck panel 14 is positioned between the center deck panel 12 and the outer deck panel 18.

When the boat is in non-collapsed condition for use as a boat, the panels 12, 14, 16 and 18 are all oriented horizontally. This can be seen in FIG. 1, for example. When, however, the boat is to be collapsed for storage or transport, for example on a trailer, the center deck panels are moved from a horizontal orientation to a vertical orientation as shown in FIG. 2, for example. Pontoons 20 are connected to the outer deck panels 16, 18. The outer deck panels move toward one another when the center deck panels are moved to a vertical orientation and the pontoons 20 move along with the outer deck panels.

The deck panels each have two components—a rigid supporting framework and the panel per se, which may be formed of any suitable material such as plywood and is supported by and disposed above the supporting framework. So that details of the operation of the collapsible boat can readily be seen, only the supporting framework is shown in certain figures, namely, FIGS. 3–7. The supporting framework for the center deck panels is identified by reference numeral 24 and the supporting framework for the outer deck panels is identified by reference numeral 26. Each supporting framework is of unitary, rigid construction, being comprised of steel, aluminum or any other suitable material. The panels of the center deck panels supported by framework 24 are identified by reference numeral 28. The panels of the outer deck panels supported by framework 26 are identified by reference numeral 30.

Parallel beams 36 extend between the outer deck panels 16, 18. The ends of the beams are located in brackets 38 affixed to the supporting frameworks 26 of the outer deck panels.

Rollers 40 (see FIG. 6) are located at the tops and bottoms of the brackets 38 so that the beams 36 freely ride or float relative to the brackets. The beams 36 cooperating with brackets 38 comprise guide means guiding movement of the outer deck panels. Stops 42 at the beam ends are engageable with brackets 38 to prevent the beams from exiting the brackets.

An electrically operated jack is employed to move the outer deck panels toward and away from one another. The electric jack includes a housing 42 secured to framework 26 of outer deck panel 18 and an elongated threaded screw member 44 which can be extended or retracted by the motor (not shown) within housing 42. At its distal end screw member 44 is attached to a pivoted arm 46 depending from supporting framework 26 of outer deck panel 16. This may best be seen with reference to FIGS. 12–15. The upper end of arm 46 is pivotally connected to the outer deck panel 16 at an elongated rod 48 (see FIGS. 4 and 5). Rod 48 extends a significant portion of the length of outer deck panel 16 and is connected to arms 46 located at the ends of the rod 48.

Figure 5:
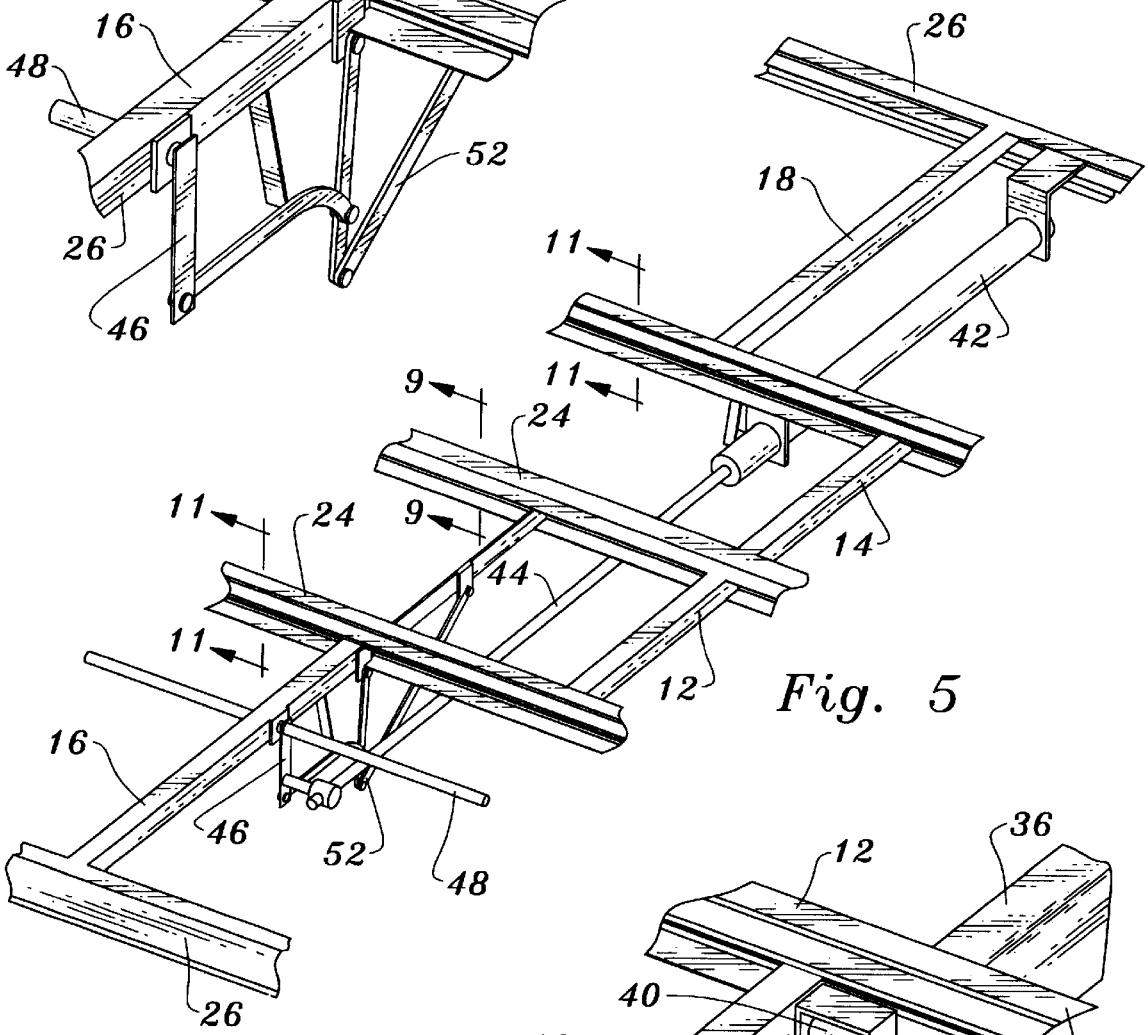
FIG. 5 is a perspective view of that portion of the boat delineated by line 5—5 in FIG. 3.
Figure 6:
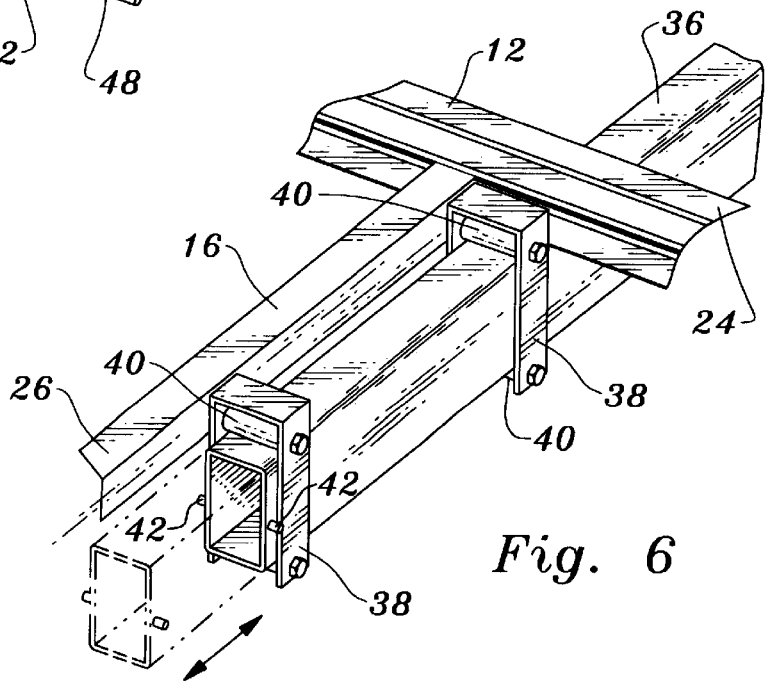
FIG. 6 is a perspective view of that portion of the boat delineated by line 6—6 in FIG. 3 and illustrating one of the components in alternate positions.
Figure 7:
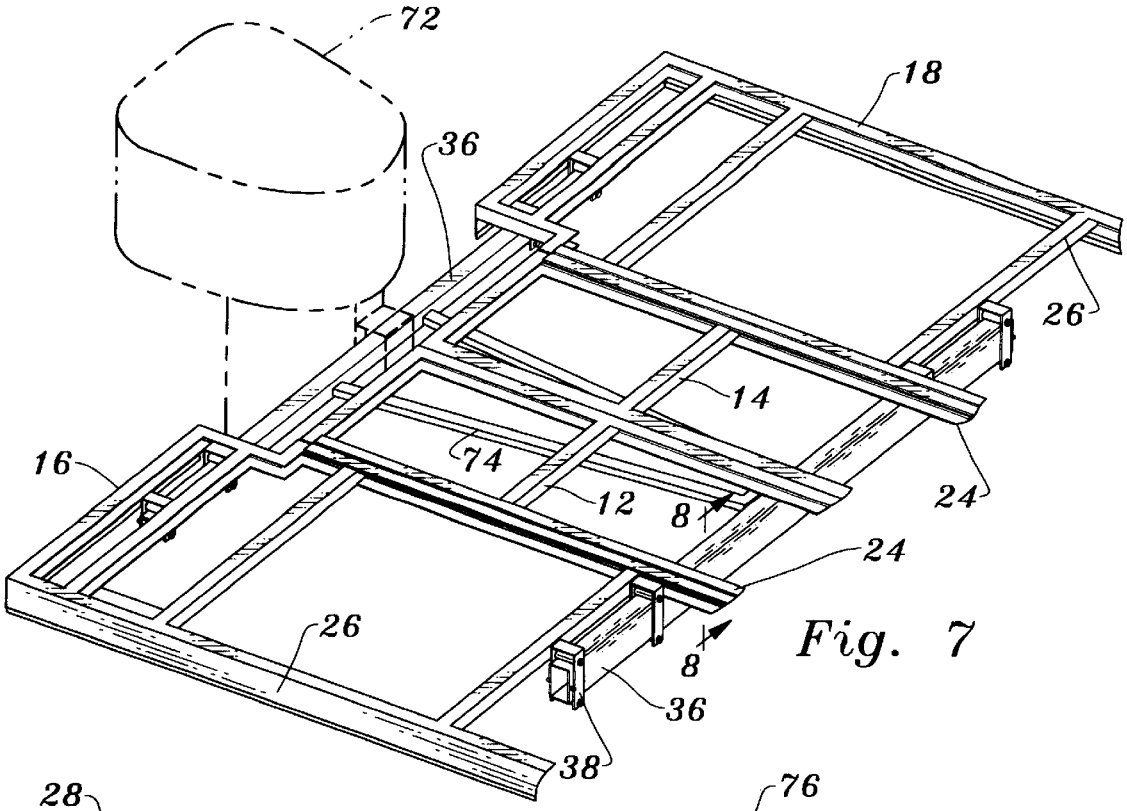
FIG. 7 illustrates a rear portion of the boat including motor mounting structure, the outer portions of the deck panels having been removed and a motor illustrated in phantom lines.

FIG. 5 shows the supporting frameworks of all of the panels in their non-collapsed positions. By actuating the motor of the jack within housing 42 to retract the screw member 44 the outer deck panels 16, 18 will be pulled toward one another, the outer deck panels sliding relative to the beams 36. The pulling force will be exerted on the supporting framework 26 of outer deck panel 16 at three locations, i.e. the locations of arms 46.

It will be appreciated that, unless displaced, the center deck panels will prevent movement of the outer deck panels toward one another. The boat includes structure which will automatically cause the center deck panels to move to a vertical orientation upon movement of the outer deck panels toward one another.

Arms 46 are each connected to a mechanical linkage 52 including a link arm 54 pivotally connected at its end to supporting framework 24 of center deck panel 12. FIGS. 12 through 15 illustrate how the mechanical linkage cooperates responsive to sliding of outer deck panels 16, 18 toward one another to raise the center deck panels from a horizontal position to a vertical position.

Figure 11:
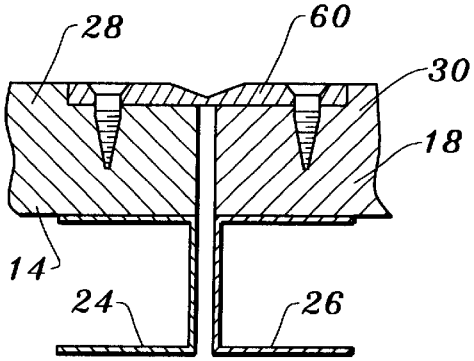
FIG. 11 is a greatly enlarged, sectional view similar to that of FIG. 9 but taken along the line 11—11 in FIG. 5, a hinge illustrated therein being shown in alternate positions.
Figure 12:
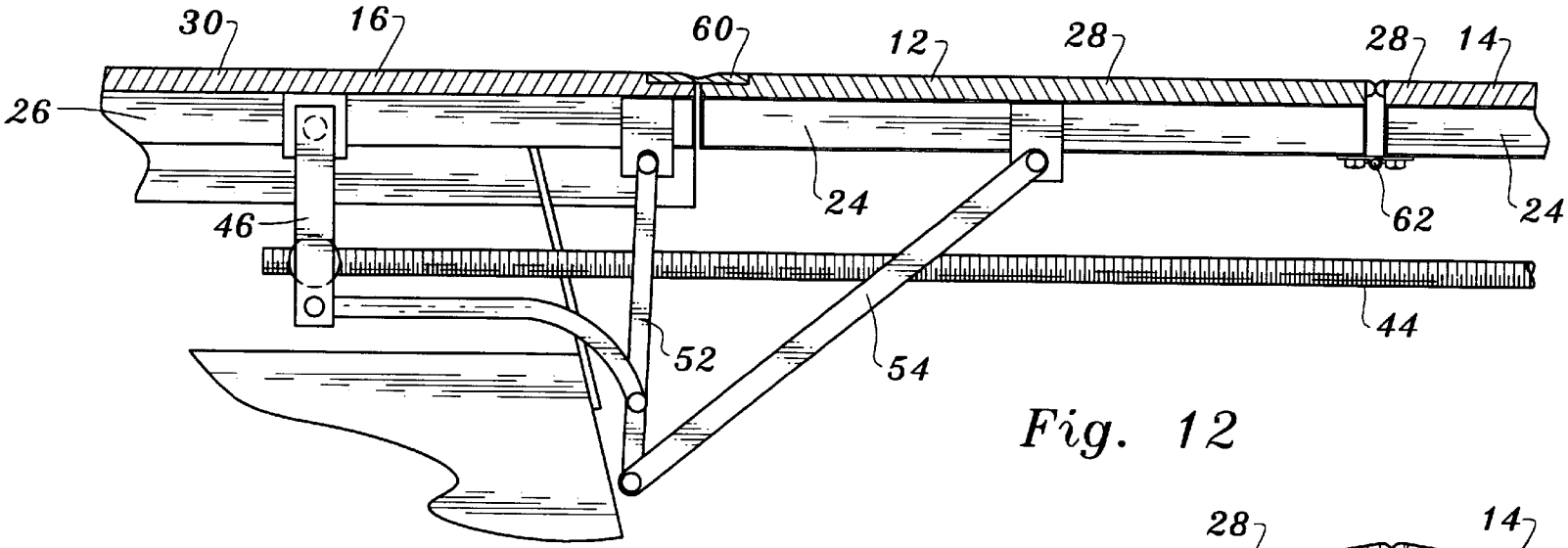
FIGS. 12, 13, 14 and 15 are partial, sectional, elevated views illustrating structure associated with an outer deck panel and a center deck panel for raising and lowering the center deck panel responsive to movement of the outer deck panel by a threaded panel mover, the figures illustrating the structure during sequential stages of operation when collapsing the boat.

Hinges 60 interconnect the center deck panels to their respective outer deck panels. The hinges 60 may be formed of any suitable material such as plastic. The hinges 60 are located at the top surface of the panels as shown in FIG. 11, for example. As may perhaps best be seen with reference to FIGS. 9 and 10, the center deck panels are also pivotally connected by means of hinges, in particular, hinges 62. Opposed pivoted ends of each hinge 62 define slots 64. Bolts or other mechanical fasteners 66 pass through the slots 64 and secure the hinges 62 to the supporting framework 24 in a fashion which will allow the hinge to move or slide relative to the supporting framework and the bolts 66 as indicated by the double-headed arrows in FIG. 10.

Figure 9:
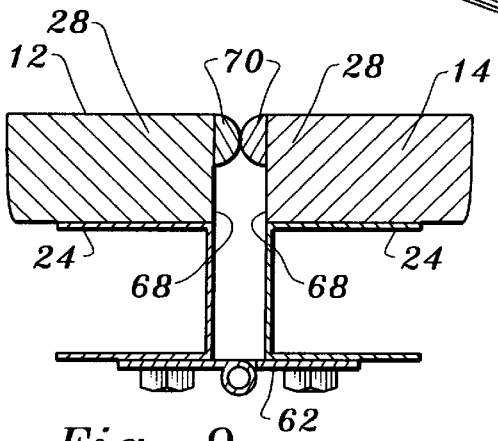
FIG. 9 is a greatly enlarged, sectional, partial view taken along the line 9—9 in FIG. 5 and illustrating outer portions of the center deck panels of the boat in place with the boat in non-collapsed condition.
Figure 8:
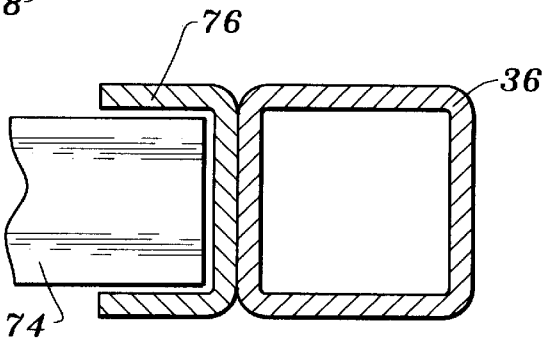
FIG. 8 is a greatly enlarged sectional view taken along the line 8—8 in FIG. 7.
Figure 10:
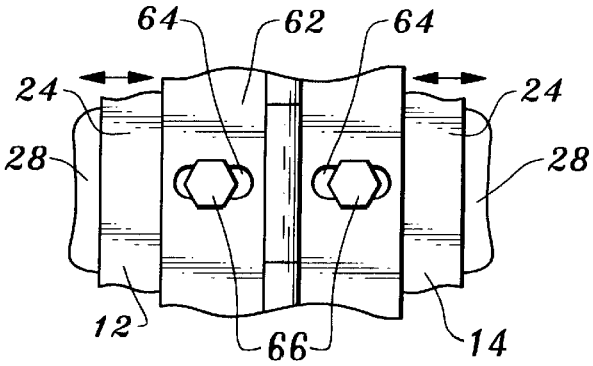
FIG. 10 is a bottom view of that segment of the boat illustrated in FIG. 9.

The center deck panels 12, 14 have side walls 68 which are spaced from one another and define a gap therebetween. Each hinge 62 bridges the gap at the bottoms of the center deck panels. Abutment members 70 extending from the center deck panels are in contact when the center deck panels are horizontal (as shown in FIG. 9) to maintain the panels in position relative to one another to form the gap.

Figure 13:
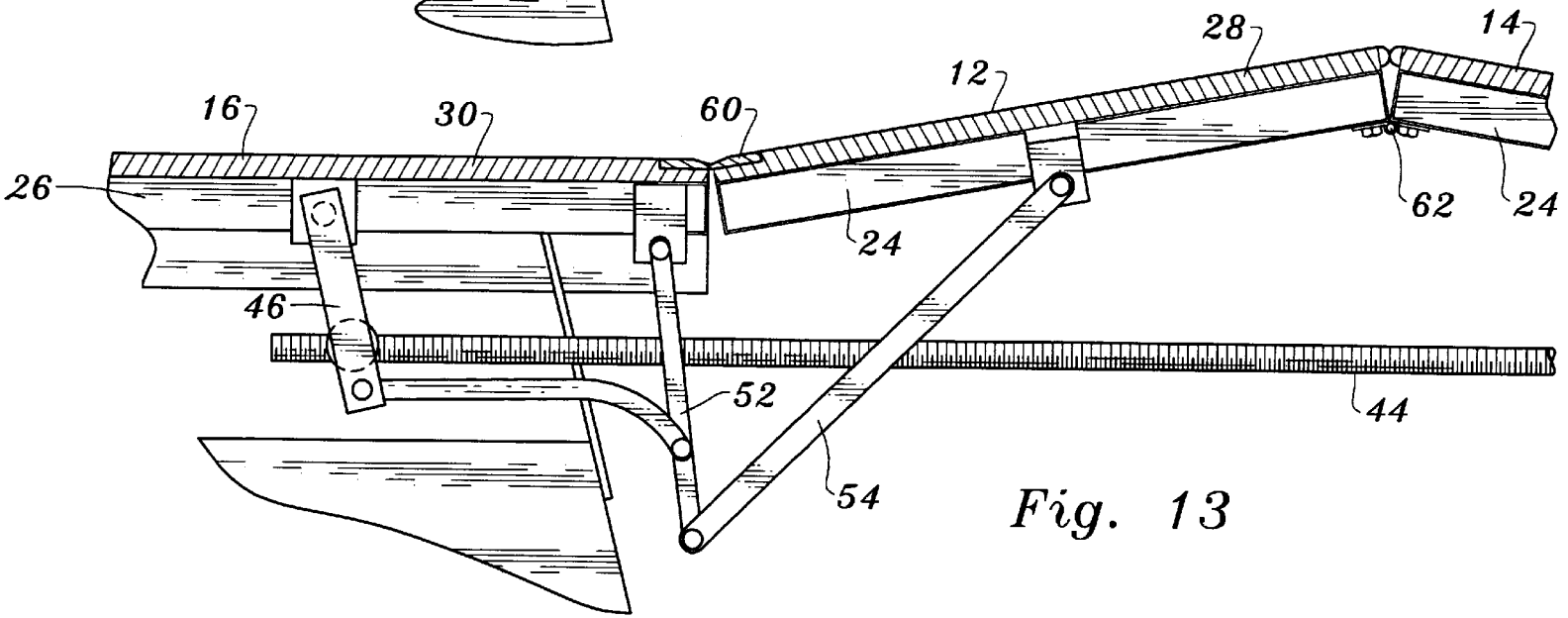
Figure 14:
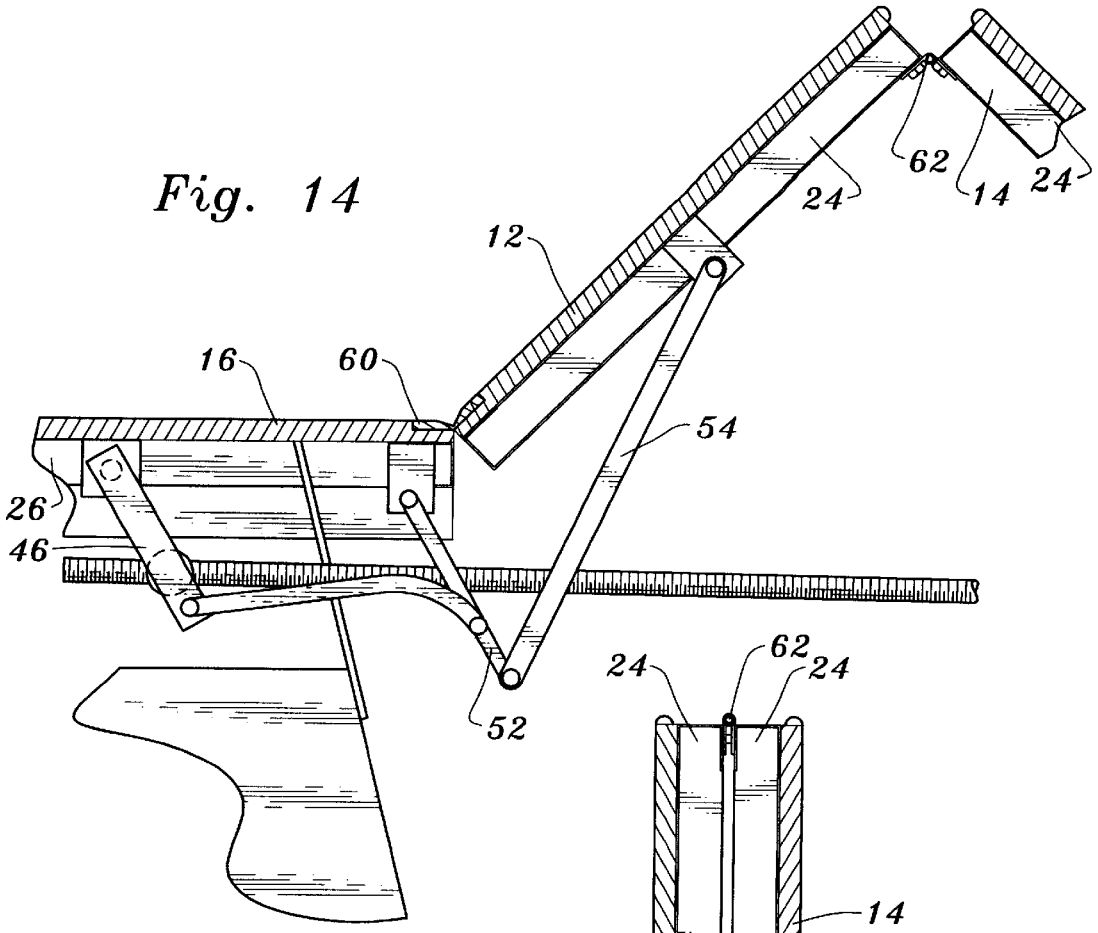
Figure 15:
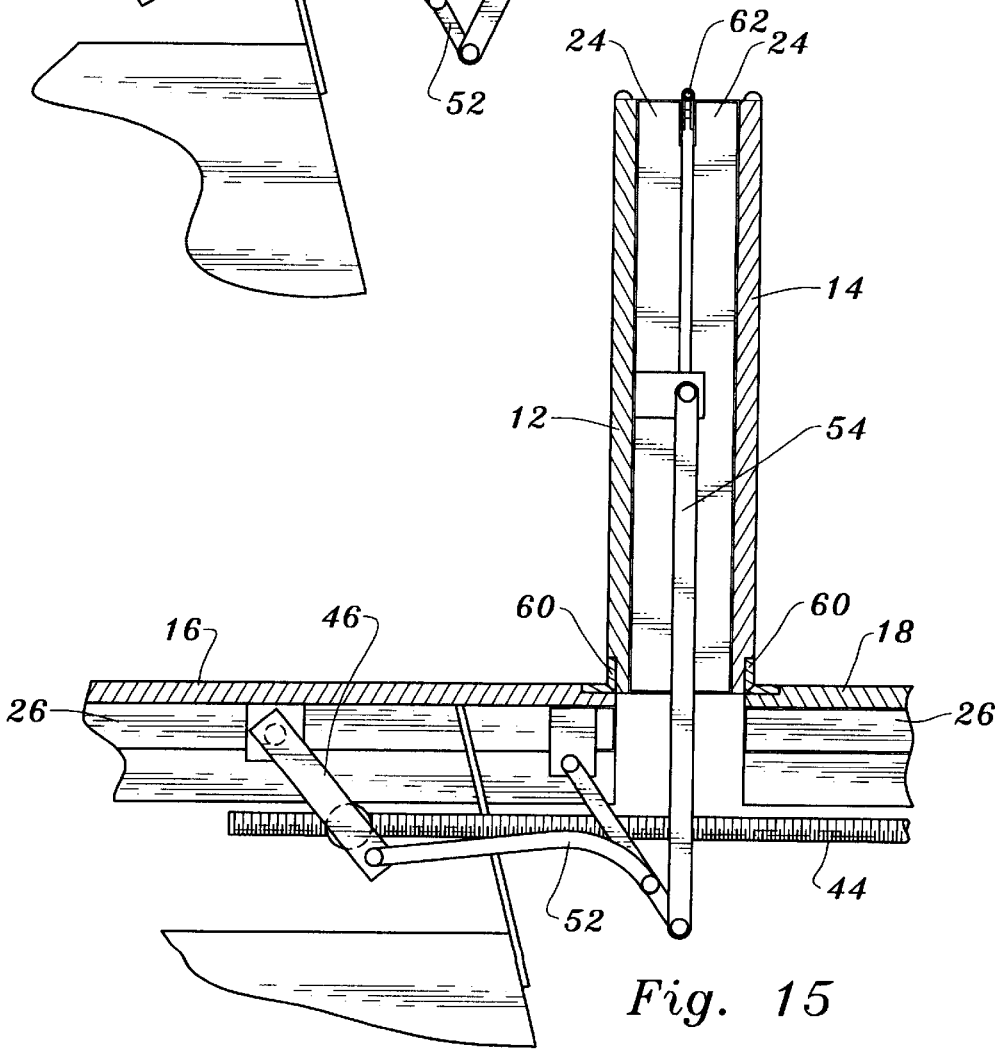
Figure 16:
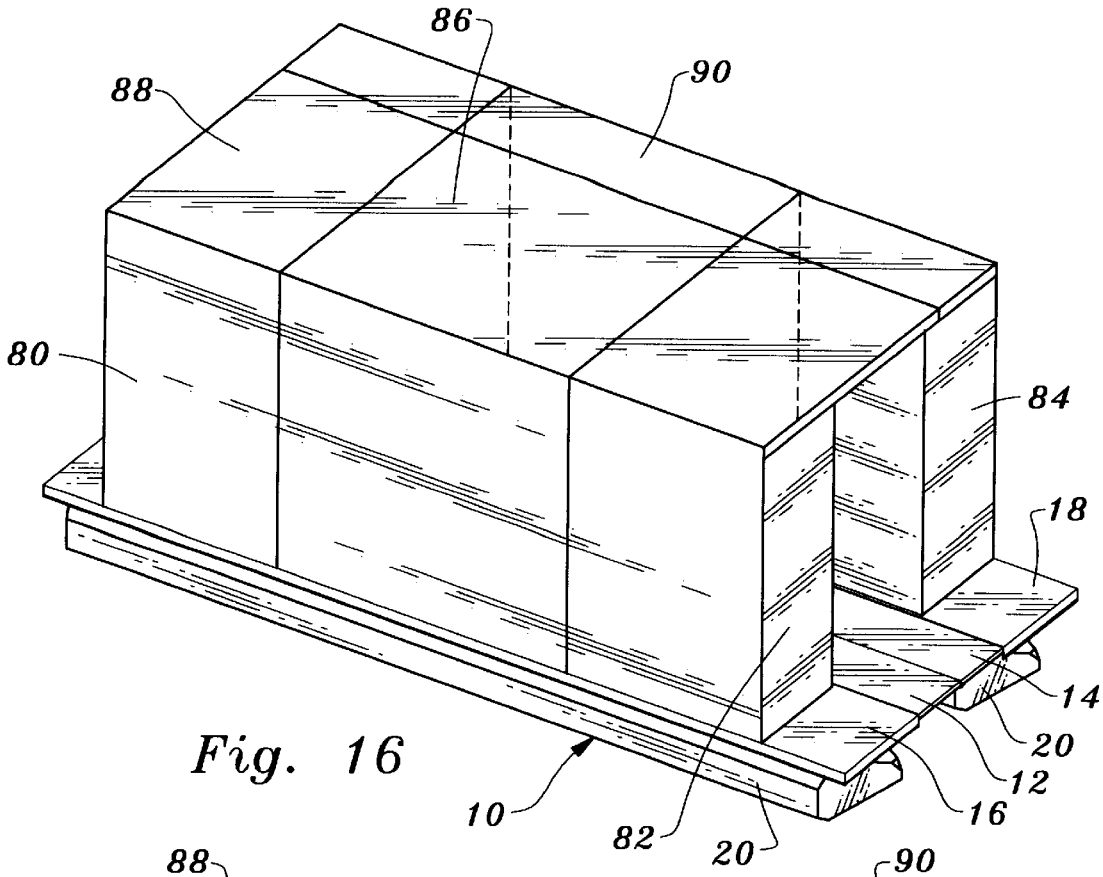
FIG. 16 is a perspective view illustrating a shelter connected to the boat deck of the boat in non-collapsed condition.
Figure 17:
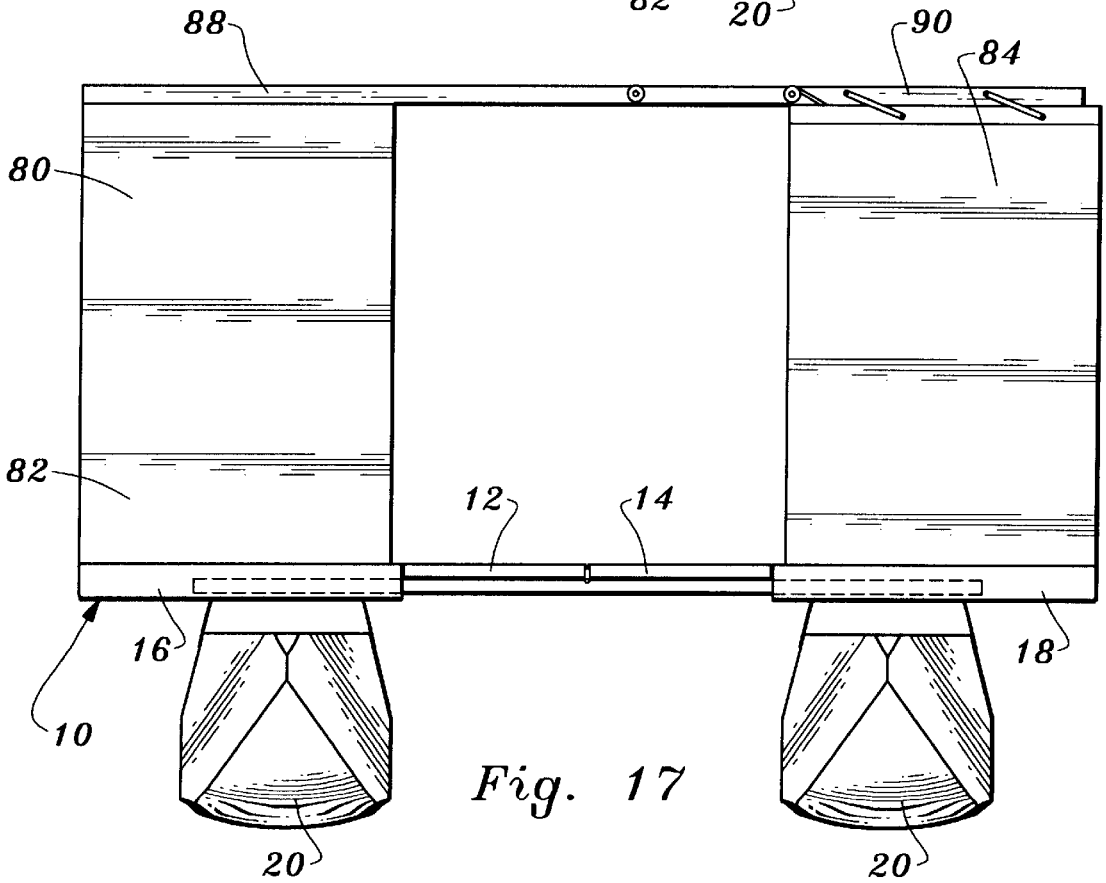
FIG. 17 is a front elevational view of the arrangement shown in FIG. 16.

The gap between the center deck panels and the floating hinge construction are quite important since they permit the outer deck panels to move toward one another without the center deck panels binding together to jam up or interfere with the operation. It is appreciated that if the side walls 68 were in abutting engagement when the process started the center deck panels would not have sufficient clearance to pivot relative to one another as shown in FIG. 13 during the initial stage of the operation which brings the center deck panels to a vertical orientation.

Figure 2:
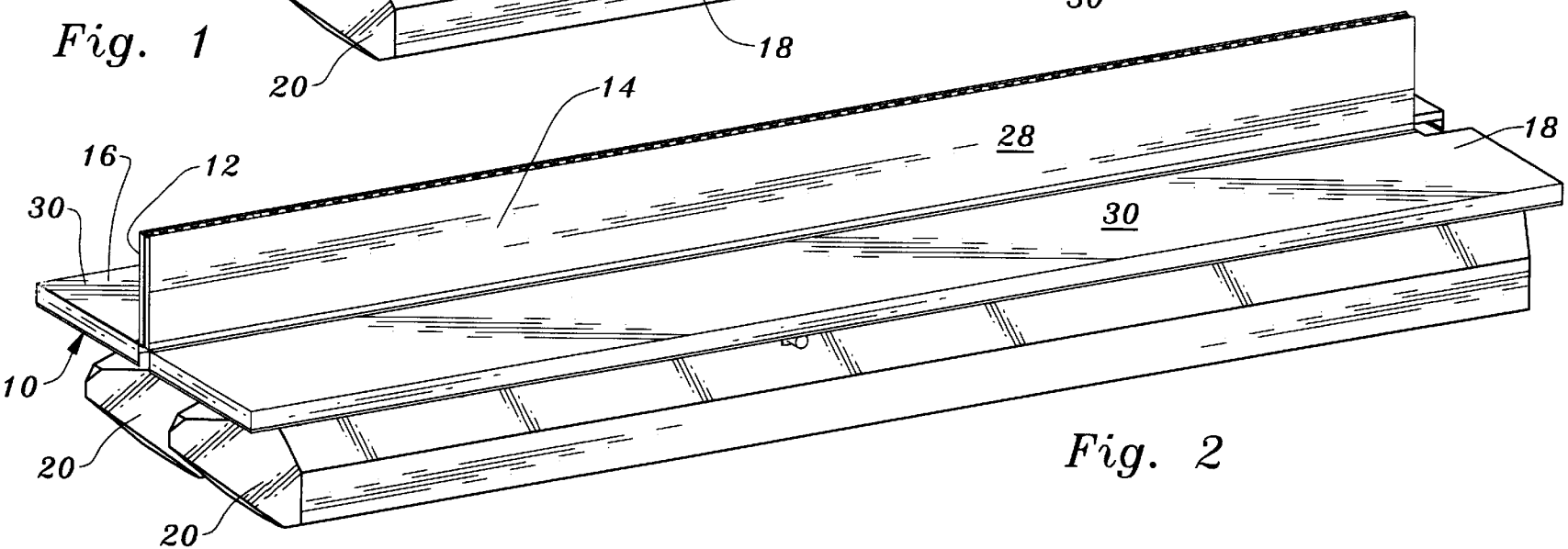
FIG. 2 is a view similar to FIG. 1 but illustrating the boat in collapsed condition, the boat having a reduced width in the collapsed condition.
Figure 3:
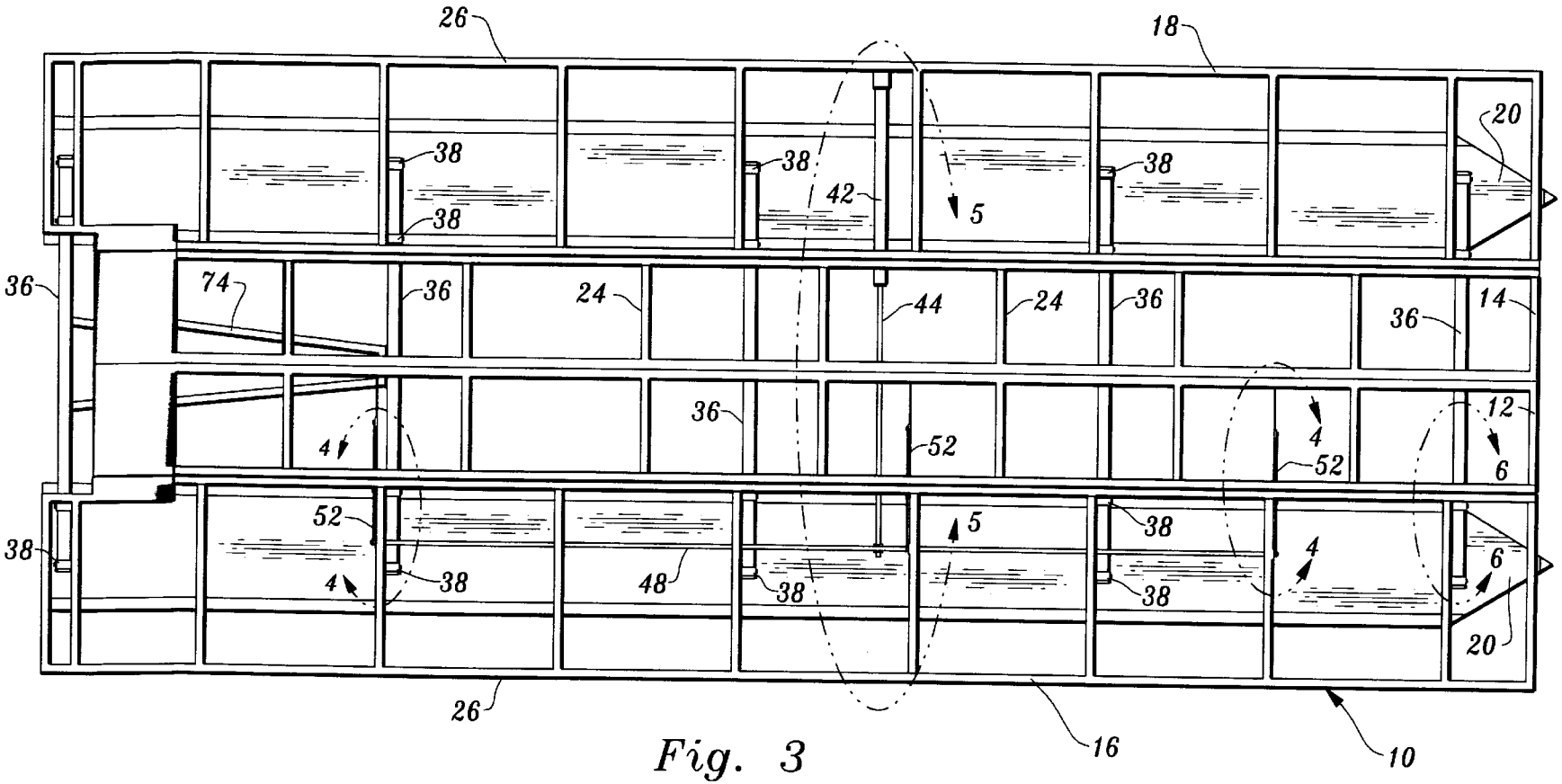
FIG. 3 is a top plan view of the boat with outer portions of the deck panels removed to provide a clear showing of the rest of the boat structure.
Figure 4:
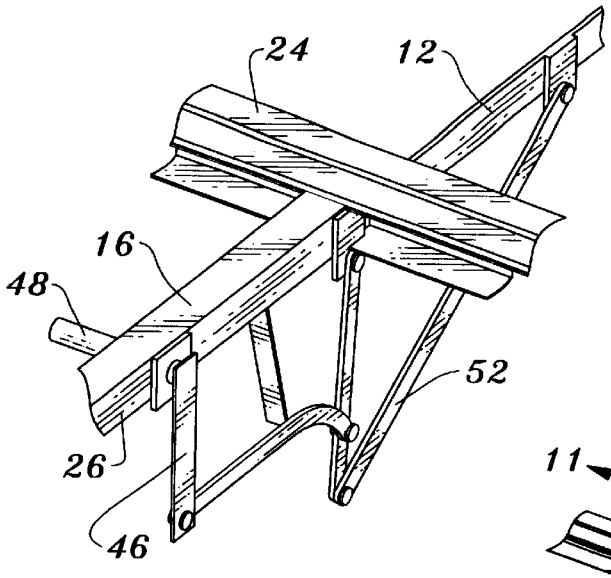
FIG. 4 is a perspective, partial view of that portion of the boat delineated by lines 4—4 in FIG. 3.

Reversal of the electric jack will result in the screw member 44 causing the deck panels to return to the original condition shown in FIG. 1.

The beam 36 at the stern of the boat may be used to support a motor 72. To prevent torquing of the beam 36 by the motor a V-shaped beam structure 74 is affixed to rearmost beam 36 and extends forwardly into a bracket 76 welded or otherwise secured to the adjacent beam 36 of the boat. The distal end of structure 74 is not attached to the bracket 76 but the bracket arms will restrict up and down movement thereof relative to the beam structure.

Figure 18:
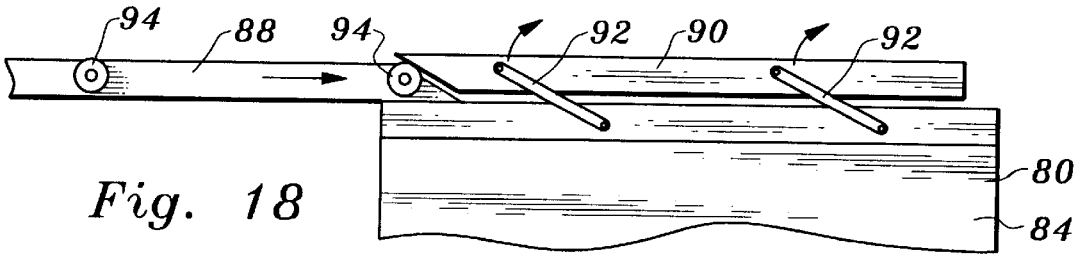
FIG. 18 is a schematic, front elevational view illustrating a portion of the roof of the shelter including two relatively movable roof segments in the positions assumed thereby during an initial stage of collapse of the boat.
Figure 19:
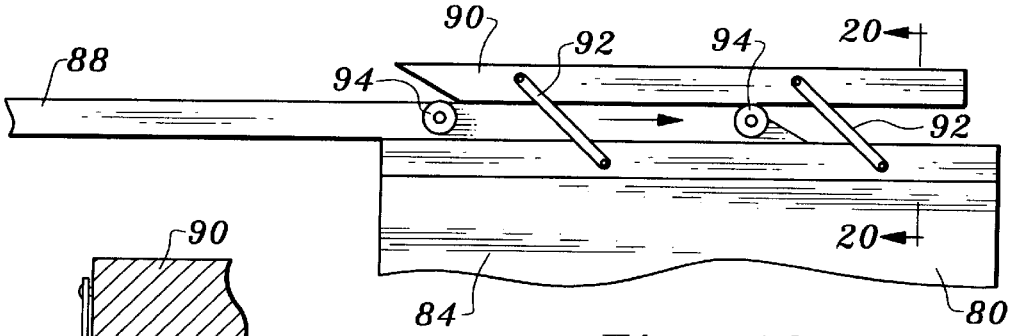
FIG. 19 is a view similar to FIG. 18 but illustrating the relative positions assumed by the roof segments at a later stage of the boat collapsing operation.
Figure 20:
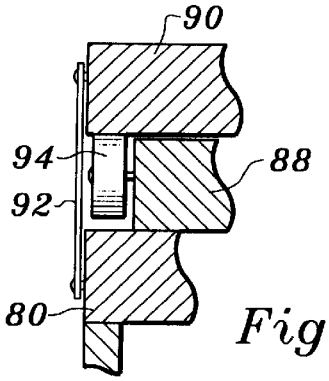
FIG. 20 is a greatly enlarged, cross-sectional view taken along the line 20—20 of FIG. 19.
Figure 21:
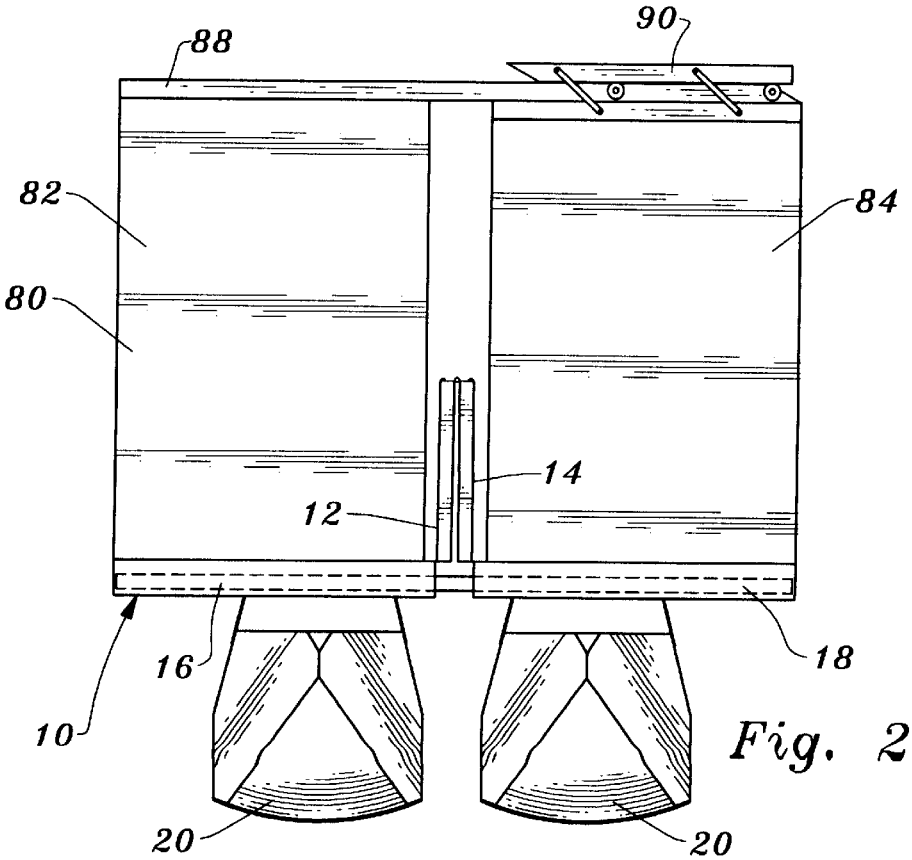
FIG. 21 is a view similar to FIG. 17 but illustrating the boat in collapsed condition.

Referring now to FIGS. 16 through 21, a shelter 80 is shown positioned on the boat. The shelter 80 has two sides 82, 84 which are supported respectively by outer deck panels 16, 18. The shelter does not rest on center deck panels 12, 14. Shelter 80 also includes a roof 86 including a roof segment 88 movable with outer deck panel 16 and a roof segment 90 movable with outer deck panel 18. The roof segment 90 is pivotally connected to pivot arms 92 which in turn are pivotally connected to shelter side 84 of the shelter. When the outer deck panels 16, 18 of the boat move together to the position shown in FIG. 21, the angled inner end of roof segment 90 will engage a roller 94 on roof segment 88. The segment 90 will rise as shown in FIGS. 18 and 19 to allow the roof segment 88 to move under roof segment 90, thus reducing the width of the shelter. FIG. 21 shows the boat and roof in collapsed condition.

What is claimed is:

1. A collapsible boat comprising, in combination:

a boat deck comprising a plurality of boat deck panels including first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel;

panel mover means for selectively moving said first and second outer deck panels either toward or away from one another, said first and second center deck panels moving from a substantially horizontal orientation to a substantially vertical orientation when said first and second outer deck panels move toward one another to reduce the width of said boat deck; and guide means for guiding movement of said first and second outer deck panels, said panel mover means being operatively associated with said first and second outer deck panels to move said first and second outer deck panels along said guide means, and said first and second center deck panels moving responsive to movement of said first and second outer deck panels.

2. The collapsible boat according to claim 1 wherein pontoons are attached to said first and second outer deck panels.

3. The collapsible boat according to claim 1 additionally comprising hinge means interconnecting said plurality of boat deck panels.

4. The collapsible boat according to claim 1 wherein said panel mover means includes mechanical linkage extending between said first outer deck panel and said first center deck panel.

5. The collapsible boat according to claim 1 wherein said first outer deck panel is pivotally connected to said first center deck panel and wherein said second outer deck panel is pivotally connected to said second center deck panel.

6. The collapsible boat according to claim 5 wherein said first and second center deck panels are pivotally interconnected.

7. The collapsible boat according to claim 1 wherein said panel mover means includes at least one rotatable elongated threaded member extending between said first and second outer deck panels and threadedly interconnected to at least one of said first and second outer deck panels.

8. The collapsible boat according to claim 1 wherein said first and second center deck panels have adjacent distal side walls spaced from one another and defining a gap therebetween, said collapsible boat additionally comprising hinge means pivotally interconnecting said first and second center deck panels and extending across said gap.

9. The collapsible boat according to claim 8 additionally comprising abutment members projecting from said distal side walls and extending across said gap, said abutment members being spaced from said hinge means.

10. The collapsible boat according to claim 8 wherein said hinge means is slidably mounted on said first and second center deck panels.

11. The collapsible boat according to claim 1 additionally including a motor mount located between said first and second outer deck panels and a structural element attached to said motor mount to substantially prevent torquing of the motor mount by a motor connected to said motor mount.

12. The collapsible boat according to claim 1 wherein said guide means comprises a plurality of parallel spaced beams extending between said first and second outer deck panels.

13. The collapsible boat according to claim 12 wherein said first and second outer deck panels are slidable relative to said beams.

14. The collapsible boat according to claim 13 additionally comprising stop means located on said beams for limiting relative movement between said first and second outer deck panels and said beams.

15. A collapsible boat comprising, in combination:

a boat deck comprising a plurality of boat deck panels including first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel;

panel mover means for selectively moving said first and second outer deck panels either toward or away from one another, said first and second center deck panels moving from a substantially horizontal orientation to a substantially vertical orientation when said first and second outer deck panels move toward one another to reduce the width of said boat deck, said first and second center deck panels having adjacent distal side walls spaced from one another and defining a gap therebetween; and hinge means pivotally interconnecting said first and second center deck panels and extending across said gap, said hinge means being slidably mounted on at least one of said first and second center deck panels.

16. A collapsible boat comprising, in combination:

a boat deck comprising a plurality of boat deck panels including first and second center deck panels disposed side-by-side and first and second outer deck panels, said first outer deck panel being disposed alongside said first center deck panel and said first center deck panel being positioned between said second center deck panel and said first outer deck panel, said second outer deck panel being disposed alongside said second center deck panel and said second center deck panel being positioned between said first center deck panel and said second outer deck panel;

panel mover means for selectively moving said first and second outer deck panels either toward or away from one another, said first and second center deck panels moving from a substantially horizontal orientation to a substantially vertical orientation when said first and second outer deck panels move toward one another to reduce the width of said boat deck; and a shelter connected to said boat deck and extending upwardly therefrom, said shelter defining an interior and including a first shelter portion and a second shelter portion, said first shelter portion attached to said first outer deck panel and said second shelter portion attached to said second outer deck panel, said shelter portions being movable with their respective attached outer deck panels toward or away from one another when said first and second outer deck portions are moved by said panel mover means.

17. The collapsible boat according to claim 16 wherein said shelter includes a roof comprising a plurality of roof segments, at least one of said roof segments being displaceable relative to the other of said roof segments to selectively reduce the size of said roof.

18. The collapsible boat according to claim 17 additionally comprising means for displacing at least one of said roof segments to reduce the size of said roof responsive to movement of said first and second outer deck panels toward one another.

* * * * *